US010131172B2

(12) United States Patent
Einsla et al.

(10) Patent No.: US 10,131,172 B2
(45) Date of Patent: Nov. 20, 2018

(54) THERMALLY PRINTABLE PAPER ARTICLE WITH ELASTIC INTERSPERSING LAYER

(71) Applicants: Dow Global Technologies LLC, Midland, MI (US); Rohm and Haas Company, Philadelphia, PA (US)

(72) Inventors: Brian Einsla, Collegeville, PA (US); Andrew Hejl, Lansdale, PA (US); Lanfang Li, Somerset, NJ (US); John A. Roper, III, Midland, MI (US); Rebecca Smith, Ambler, PA (US); Jian Yang, Lake Jackson, TX (US)

(73) Assignees: Dow Global Technologies LLC, Midland, MI (US); Rohm and Haas Company, Philadelphia, PA (US)

( * ) Notice: Subject to any disclaimer, the term of this patent is extended or adjusted under 35 U.S.C. 154(b) by 0 days.

(21) Appl. No.: 15/593,612

(22) Filed: May 12, 2017

(65) Prior Publication Data

US 2017/0334229 A1 Nov. 23, 2017

Related U.S. Application Data

(60) Provisional application No. 62/339,128, filed on May 20, 2016.

(51) Int. Cl.

| | |
|---|---|
| ***B41M 5/337*** | (2006.01) |
| ***B41M 5/50*** | (2006.01) |
| ***B05D 7/00*** | (2006.01) |
| ***D21H 19/20*** | (2006.01) |
| ***D21H 19/64*** | (2006.01) |
| ***B41M 5/42*** | (2006.01) |
| *B41M 5/44* | (2006.01) |

(52) U.S. Cl.

CPC ..... *B41M 5/502* (2013.01); *B05D 7/544* (2013.01); *B41M 5/3372* (2013.01); *B41M 5/42* (2013.01); *D21H 19/20* (2013.01); *D21H 19/64* (2013.01); *B41M 5/426* (2013.01); *B41M 5/44* (2013.01); *B41M 2205/04* (2013.01); *B41M 2205/32* (2013.01); *B41M 2205/38* (2013.01)

(58) Field of Classification Search

CPC ..... B41M 3/337; B41M 3/3372; B41M 5/42; B41M 5/426; B41M 5/44; B41M 5/50; B41M 5/502; B41M 5/506; B41M 2205/04; B41M 2205/32; B41M 2205/38; B41M 5/337; B41M 5/3372

USPC ..... 428/32.39, 32.5; 503/200, 207

See application file for complete search history.

(56) References Cited

U.S. PATENT DOCUMENTS

| | | | |
|---|---|---|---|
| 4,929,590 | A | 5/1990 | Maruta et al. |
| 4,975,408 | A | 12/1990 | Motosugi et al. |
| 6,710,015 | B2 | 3/2004 | Kaneko et al. |
| 8,415,270 | B2 | 4/2013 | Yada et al. |
| 2011/0092365 | A1 | 4/2011 | Ohga |
| 2013/0053240 | A1 | 2/2013 | Takahama et al. |

FOREIGN PATENT DOCUMENTS

| | | | |
|---|---|---|---|
| DE | 102005050418 | A1 | 4/2007 |
| EP | 2554392 | A1 | 2/2013 |
| JP | H0911624 | A | 1/1997 |
| JP | 2002052830 | A | 2/2002 |
| JP | 2006001237 | A | 1/2006 |
| JP | 2006035594 | A | 2/2006 |
| JP | 2007203538 | A | 8/2007 |
| JP | 2008105223 | A | 5/2008 |
| JP | 4676732 | B2 | 4/2011 |
| WO | 2013036700 | A2 | 3/2013 |

*Primary Examiner* — Bruce H Hess

(74) *Attorney, Agent, or Firm* — Reid S. Willis

(57) ABSTRACT

The present invention relates to a thermally printable paper article with an elastomeric underlayer, which imparts improved printing performance.

5 Claims, No Drawings

THERMALLY PRINTABLE PAPER ARTICLE WITH ELASTIC INTERSPERSING LAYER

BACKGROUND OF THE INVENTION

The present invention relates to a thermally printable paper article comprising a layer of thermosensitive recording material and interconnecting elastomeric particles. The article of the present invention provides improved printing performance by virtue of this layer.

In direct thermal printing, a thermal printhead comes in direct contact with paper to heat the paper and produce an image. When the paper does not contact the printhead completely, the heat conveyed to the paper tends to diffuse, resulting in unfavorably low energy efficiency. Conventionally, thermal papers are produced with high smoothness to achieve better contact between the printer and the paper; nevertheless, the match is imperfect and, consequently, defects are manifested in the image in the form of missing dots. These missing dots, which are voids found in, for example, bars of a barcode or spots found in spaces of the code that are read as irregularities in the reflectance profile, result in poor barcode readability.

It would therefore be an advantage in the art of thermal printing to find a way to improve print performance by improving contact between the printhead and the paper.

SUMMARY OF THE INVENTION

The present invention addresses a need in the art by providing, in a first aspect, a coated paper article comprising:

a) a 40-μm to 500-μm thick paper substrate;

b) a 2-μm to 10-μm thick pigmented heat insulating layer comprising insulating particles selected from the group consisting of hollow sphere polymer particles, clay particles, and zeolite particles disposed over the paper substrate; and c) a 1-μm to 30-μm thick layer, comprising thermosensitive recording material and interconnecting elastomeric polymer particles having a compressive modulus in the range of from $10^2$ Pa to $10^8$ Pa, which is disposed over the pigmented heat insulating layer.

In a second aspect, the present invention is a coated paper article comprising:

a) a 40-μm to 500-μm thick paper substrate;

b) a 2-μm to 10-μm thick pigmented heat insulating layer comprising insulating particles selected from the group consisting of hollow sphere polymer particles, clay particles, and zeolite particles disposed over the paper substrate; and c) a 1-μm to 30-μm thick layer, comprising thermosensitive recording material and interconnecting elastomeric polymer particles having a core-shell morphology, which is disposed over the pigmented heat insulating layer;

wherein the weight-to-weight ratio of the core to the shell is in the range of from 80:20 to 98:2; wherein the core comprises, based on the weight of the core, from 90 to 99.9 weight percent structural units of a monomer selected from the group consisting of ethyl acrylate, butyl acrylate, 2-ethylhexyl acrylate, and 2-propylheptyl acrylate, and from 0.1 to 10 weight percent structural units of a multiethylenically unsaturated monomer.

The article of the present invention provides a way to improve print performance by mitigating the adverse effects of pressure applied to the paper.

DETAILED DESCRIPTION OF THE INVENTION

In a first aspect, the present invention is a coated paper article comprising:

a) a 40-μm to 500-μm thick paper substrate;

b) a 2-μm to 10-μm thick pigmented heat insulating layer comprising insulating particles selected from the group consisting of hollow sphere polymer particles, clay particles, and zeolite particles disposed over the paper substrate; and c) a 1-μm to 30-μm thick layer, comprising thermosensitive recording material and interconnecting elastomeric polymer particles having a compressive modulus in the range of from $10^2$ Pa to $10^8$ Pa, which is disposed over the pigmented heat insulating layer.

The article of the present invention is advantageously prepared by sequential drawdowns of aqueous coating formulations. An insulating layer is advantageously formed by applying an aqueous dispersion of hollow sphere polymer particles or an aqueous suspension of clay or zeolite particles to the paper substrate using, for example, a wire-wound rod at controlled speed on a drawdown machine and drying applied coating. Commercially available aqueous dispersions of hollow sphere polymer particles include ROPAQUE™ TH-2000 Hollow Sphere Polymer, ROPAQUE™ AF-1055 Hollow Sphere Polymer, and ROPAQUE™ Ultra E Opaque Polymer. (A Trademark of The Dow Chemical Company or its Affiliates.) The particle size of the hollow sphere polymers is typically in the range of from 275 nm, more preferably from 350 nm, to preferably 2 μm, more preferably to 1.8 μm, and most preferably to 1.6 μm. Preferably, thickness of the insulating layer is in the range of from 4 μm to 8 μm (corresponding to ~1.4 g/m$^2$ to 10 g/m$^2$, depending on the density of the insulating material.)

In a preferred method of creating the layer of the interconnecting elastomeric polymer particles and the thermosensitive recording material, a mixture of an aqueous dispersion of the elastomeric polymer particles and thermosensitive recording material is applied to the paper substrate. The coated paper is then advantageously dried at advance temperatures.

The elastomeric polymer particles have a compressive modulus in the range of from $10^3$ Pa, preferably from $10^4$ Pa, more preferably from $10^6$ Pa to $10^8$ Pa, and preferably characterized by a core-shell morphology, wherein the core comprises from 80, more preferably from 85, and most preferably from 90 weight percent, to preferably 98, and more preferably to 96 weight percent of the polymer particles, and the shell comprises preferably from 2, more preferably from 5 weight percent, to preferably 20, more preferably to 15, and most preferably to 10 weight percent of the polymer particles.

The core preferably comprises, based on the weight of the core, from 90, more preferably from 95, and most preferably from 98 weight percent, to preferably 99.9, more preferably to 99.8, and most preferably to 99.5 weight percent structural units of a monomer selected from the group consisting of ethyl acrylate, butyl acrylate, 2-ethylhexyl acrylate, and 2-propylheptyl methacrylate. The core preferably further comprises, based on the weight of the core, from 0.1, more preferably from 0.2, and most preferably from 0.5 weight percent, to preferably 10, more preferably to 5, and most preferably to 2 weight percent structural units of a multiethylenically unsaturated monomer. Preferred multiethylenically unsaturated monomers are diethylenically unsaturated monomers such as allyl methacrylate, divinylbenzene, butylene glycol diacrylate, ethylene glycol diacrylate, butylene glycol dimethacrylate, and ethylene glycol dimethacrylate.

The shell preferably comprises structural units of at least one monomer selected from the group consisting of methyl methacrylate, styrene, acrylonitrile, and t-butyl methacrylate. Preferably, at least 90%, more preferably at least 95%, and most preferably at least 98% of the core comprises structural units of butyl acrylate and allyl methacrylate; preferably at least 90%, more preferably at least 95%, and most preferably at least 98% of the shell comprises structural units of methyl methacrylate.

The thermosensitive recording material typically comprises a leuco dye and a color developer (see U.S. Pat. No. 4,929,590) and may also comprise a variety of other additives including binders, fillers, crosslinking agents, surface active agents, sensitizers, and thermofusible materials. The dry w/w ratio of elastomeric polymeric particles to thermosensitive recording materials is preferably in the range of from 20:80, more preferably from 25:75 to preferably 80:20, more preferably to 75:25 based on total dry weight of the polymeric particles and the thermosensitive recording material. The preferred thickness of the layer that comprises the thermosensitive recording materials and elastomer polymer particles is from 1 μm to 15 μm (~1.5 g/m$^2$ to 22 g/m$^2$).

As the following examples demonstrate, the article of the present invention shows an improvement in optical density, which is an indicator of print quality, over coated paper that does not include a layer with interconnecting elastomeric polymer particles.

For Example 1, the elastomeric polymer particles are characterized as shown in Table 1. BA refers to butyl acrylate, ALMA refers to allyl methacrylate, and MMA refers to methyl methacrylate. Compressive Modulus was calculated as described in the section titled Calculation of Compressive Modulus.

TABLE 1

Characterization of Elastomeric Polymer Particles

| | |
|---|---|
| Core:Shell wt/wt ratio | 94:4 |
| Core (wt %) | Copolymer of BA(99.3)/ALMA(0.7) |
| Shell (wt %) | Poly (MMA) |
| Compressive Modulus | 2.1 MPa |

EXAMPLE 1

Preparation of a Coated Paper Article with Elastomeric Particles Formulated in the Thermosensitive Layer A solution of Ansilex 93 calcined clay (177.2 g, 45% solids), RHOPLEX P-308 Binder (14.6 g, 49.8% solids), polyvinyl alcohol (obtained from Kremer Pigmente, 6.5 g, 14.5% solids), and water (1.7 g) was prepared the pH of the mixture was adjusted to 7.5 and the viscosity adjusted to 400 cPs with RHOPLEX™ RM-232D Rheology Modifier (A Trademark of The Dow Chemical Co. or its Affiliates). A portion of this mixture was then applied to paper and dried as described above. The dry weight of the applied coating was 9.5 g/m$^2$.

The thermosensitive recording formulation was prepared by mixing together water (15.9 g) and a dispersant (0.01 g) with stirring. The aqueous dispersion of elastomeric polymer particles (2.4 g, 51.0% solids) were added slowly to the mixture. Stirring was continued for an additional 5 min during which time an aqueous dispersion of 4-hydroxy-4'-isopropoxydiphenylsulfone (3.0 g, 50% solids) was slowly added, followed by the addition of an aqueous dispersion of 2-benzyl-oxy-napthalene (0.6 g, 40% solids), followed by addition of an aqueous dispersion of zinc stearate (1.0 g, 36% solids), then an aqueous dispersion of 2-anilino-6-(dibutylamino)-3-methylfluoran (1.8 g, 35% solids). Finally, a solution of fully hydrolyzed polyvinyl alcohol (4.9 g, 14.5% solids) was slowly added and stirring continued for an additional 5 min. A portion of this mixture was applied on top of the calcined clay-containing basecoat and dried as described above. The dry weight of the applied coating was 3.0 g/m$^2$ (~2 μm thickness).

COMPARATIVE EXAMPLE 1

Preparation of a Coated Paper Article without Elastomeric Polymer Particles Formulated in the Thermosensitive Layer The article of the comparative example was prepared essentially as described in Example 1 except for the absence of elastomeric layer step. A solution of Ansilex 93 calcined clay (177.2 g, 45% solids), RHOPLEX P-308 Binder (14.6 g, 49.8% solids), polyvinyl alcohol (obtained from Kremer Pigmente, 6.5 g, 14.5% solids), and water (1.7 g) was prepared; the pH of the mixture was adjusted to 7.5 and the viscosity adjusted to 400 cPs with RHOPLEX RM-232D Rheology Modifier. A portion of this mixture was then applied to paper and dried as described above. The coat weight of the applied coating was 9.0 g/m$^2$.

The thermosensitive recording formulation was prepared by mixing together water (52.0 g) and a dispersant (0.03 g) with stirring. Calcium carbonate powder (4.1 g, Tunex-E from Shirashi Kogyo Kaisha, LTD) was then added slowly and stirring was continued for 5 min before silica powder (4.9 g, Mizucasil P-603 from Mizusawa Kagaku K.K.) was added slowly to the mixture. Stirring was continued for an additional 5 min during which time an aqueous dispersion of 4-hydroxy-4'-isopropoxydiphenylsulfone (9.9 g, 50% solids) was slowly added, followed by the addition of an aqueous dispersion of 2-benzyl-oxy-napthalene (2.1 g, 40% solids), followed by addition of an aqueous dispersion of zinc stearate (3.4 g), then an aqueous dispersion of 2-anilino-6-(dibutylamino)-3-methylfluoran (5.9 g, 35% solids). Finally, a solution of fully hydrolyzed polyvinyl alcohol (16.5 g, 14.5% solids) was slowly added and stirring continued for an additional 5 min. A portion of this mixture was applied on top of the calcined clay-containing basecoat and dried as described above. The coat weight of the applied coating was 3.0 g/m$^2$.

The optical densities of the two samples were measured at 8 mJ/mm$^2$ in accordance with ASTM F1405 using an Atlantek M200 thermal printer and an X-Rite optical densitometer. The coated substrate of Example 1 was found to have an optical density of 0.61 AU while the coated substrate of Comparative Example 1 was found to have an optical density of 0.37 AU. The higher optical density observed for the example of the invention correlates with significantly higher print quality.

Calculation of Compressive Modulus

Thermal Mechanical Analysis was carried out using a TA Q400 Thermomechanical Analyzer equipped with a compression sample fixture. Samples of dried coating slab were prepared by pouring a 1-mm thick aqueous coating formulation onto a smooth Teflon petri dish and drying the sample in vacuo at 50° C. The dried specimen was removed from the Teflon surface and released as a free standing pellet. On the TA Q400 instrument with probe tip fixture, the force was ramped from 0.05 N was ramped to 0.5 N, while at the same time the dimensions of the coating pellet sample were measured. The dimension and force were then calculated to yield stress and strain according to the formula:

$$\sigma = \frac{F}{A},$$

where σ is stress, F is the force applied from the probe, and A is the area of the probe in contact with the sample surface.

$$\varepsilon = \frac{l - l_0}{l_0},$$

where ε is strain, calculated from measured real time thickness of specimen l, and original thickness of specimen $l_0$ before force was applied. When strain versus stress is plotted, the slope of the strain stress curve gives the compressive modulus of the test specimen.

The invention claimed is:

1. A coated paper article comprising:

a) a 40-μm to 500-μm thick paper substrate;

b) a 2-μm to 10-μm thick pigmented heat insulating layer comprising insulating particles selected from the group consisting of hollow sphere polymer particles, clay particles, and zeolite particles disposed over the paper substrate; and c) a 1-μm to 30-μm thick layer, comprising thermosensitive recording material and interconnecting elastomeric polymer particles which is disposed over the pigmented heat insulating layer;

wherein the interconnecting elastomeric polymer particles have a core shell morphology, wherein the weight-to-weight ratio of the core to the shell is in the range of from 80:20 to 98:2; wherein the core comprises, based on the weight of the core, from 90 to 99.9 weight percent structural units of a monomer selected from the group consisting of ethyl acrylate, butyl acrylate, 2-ethylhexyl acrylate, and 2-propylheptyl acrylate, and from 0.1 to 10 weight percent structural units of a multiethylenically unsaturated monomer; and wherein the shell comprises structural units of at least one monomer selected from the group consisting of methyl methacrylate, styrene, acrylonitrile, and t-butyl methacrylate.

2. The coated paper article of claim 1 wherein the insulating particles are hollow sphere polymer particles or clay particles.

3. The coated paper article of claim 2 wherein the weight-to-weight ratio of the core to the shell is in the range of from 90:10 to 96:4; wherein the core comprises, based on the weight of the core, from 95 to 99.8 weight percent structural units of a monomer selected from the group consisting of ethyl acrylate, butyl acrylate, 2-ethylhexyl acrylate, and 2-propylheptyl acrylate, and from 0.1 to 10 weight percent structural units of a diethylenically unsaturated monomer.

4. The coated paper article of claim 3 wherein the core comprises, based on the weight of the core, from 95 to 99.5 weight percent structural units of butyl acrylate and from 0.5 to 5 weight percent structural units of the diethylenically unsaturated monomer; and wherein at least 90 percent of the shell comprises structural units of methyl methacrylate.

5. The coated paper article of claim 3 wherein the core comprises, based on the weight of the core, from 95 to 99.5 weight percent structural units of butyl acrylate and from 0.5 to 5 weight percent structural units of the diethylenically unsaturated monomer, which diethylenically unsaturated monomer is allyl methacrylate or divinylbenzene; and wherein at least 98 percent of the shell comprises structural units of methyl methacrylate.

* * * * *